US006880471B2

(12) United States Patent
Taijima et al.

(10) Patent No.: US 6,880,471 B2
(45) Date of Patent: Apr. 19, 2005

(54) MULTI-HEAD SEWING MACHINES HAVING DEVICES FOR FEEDING LONG WORKPIECES

(75) Inventors: Ikuo Taijima, Aichi-ken (JP); Terutada Kojima, Aichi-ken (JP)

(73) Assignee: Tokai Kogyo Mishin Kakushiki Kaisha, Aichi-ken (JP)

( * ) Notice: Subject to any disclaimer, the term of this patent is extended or adjusted under 35 U.S.C. 154(b) by 28 days.

(21) Appl. No.: 10/620,775

(22) Filed: Jul. 17, 2003

(65) Prior Publication Data

US 2004/0055520 A1 Mar. 25, 2004

(30) Foreign Application Priority Data

Jul. 18, 2002 (JP) ..... 2002-209851

(51) Int. Cl.[7] ..... D05C 3/02; D05C 9/04; D05B 27/10; D05B 33/00

(52) U.S. Cl. ..... 112/102; 112/155; 112/103; 112/307

(58) Field of Search ..... 112/102, 155, 112/103, 117–119, 303, 305, 307, 318, 322, 475.04, 475.07, 475.18, 217.2, 304, 311, 320; 198/402, 405, 624; 193/37; 271/109, 225

(56) References Cited

U.S. PATENT DOCUMENTS

| | | | | | |
|---|---|---|---|---|---|
| 2,321,010 | A | * | 6/1943 | Cohn | 26/1 |
| 2,374,529 | A | * | 4/1945 | Everitt | 112/475.04 |
| 4,607,582 | A | * | 8/1986 | Brocklehurst | 112/470.06 |
| 4,669,405 | A | * | 6/1987 | Resta et al. | 112/470.12 |
| 5,144,899 | A | * | 9/1992 | Allen | 112/103 |
| 5,899,155 | A | * | 5/1999 | Thoren | 112/103 |
| 6,158,366 | A | * | 12/2000 | Codos | 112/117 |
| 6,170,414 | B1 | * | 1/2001 | Kaetterhenry et al. | 112/117 |

FOREIGN PATENT DOCUMENTS

JP 61-5744 2/1986

* cited by examiner

*Primary Examiner*—Ismael Izaguirre
(74) *Attorney, Agent, or Firm*—Dennison, Schultz, Dougherty & MacDonald

(57) ABSTRACT

A multi-head sewing machine includes a machine table (10) and a plurality of sewing heads (12). The sewing heads are disposed to oppose to the machine table and arranged in a row in a first direction substantially parallel to a surface of the machine table. A workpiece setting frame (20) serves to releasably hold a long workpiece (40) and is movable within a plane substantially parallel to the surface of the machine table. A feeding mechanism (W1, 30, W2) serves to feed the workpiece relative to the workpiece setting frame in a direction substantially parallel to the first direction.

22 Claims, 12 Drawing Sheets

MULTI-HEAD SEWING MACHINES HAVING DEVICES FOR FEEDING LONG WORKPIECES

This application claims priority to Japanese patent application serial number 2002-209851, the contents of which are incorporated herein by reference.

BACKGROUND OF THE INVENTION

1. Field of the Invention

The present invention relates to multi-head sewing machines and, in particular to multihead sewing machines for repeatedly performing sewing operations, e.g., embroidering operations, onto long workpieces having a predetermined width and longitudinal direction. The present invention also relates to methods of feeding long workpieces in multi-head sewing machines.

2. Description of the Related Art

Multi-head sewing machines are known that are used for embroidering patterns onto long workpieces along the length of the workpieces. The embroidery patterns may be continuous along the length of the workpieces (hereinafter called "continuous patterns") or may not be continuous while the same patterns are intermittently embroidered along the length of the workpieces (hereinafter called "intermittent patterns"). In general, the long workpieces are partly held by embroidery frames in order to embroider "continuous patterns" or "intermittent patterns". During the embroidering operation, the embroidery frame is moved in an X-direction and a Y-direction within a plane above a machine table. The X-direction and Y-direction are perpendicular to each other. After the embroidering operation have been performed onto a part of a workpiece that is held by the embroidery frame, the workpiece is released from the embroidery frame and is fed in the longitudinal direction by a predetermined distance. Then, another part of the workpiece next to the part that has been embroidered is held by the embroidery frame and the embroidering operation is again performed. These operations are repeatedly performed to embroider a continuos pattern or intermittent patterns.

Japanese Patent Publication No. 61-5744 discloses a multi-head sewing machine that has a feeding mechanism for feeding a long workpiece that is embroidered in the same manner as described above. The feeding mechanism includes a workpiece supply stand, on which a long workpiece is stored in a rolled configuration, and a workpiece recovering stand for winding the long workpiece that has been embroidered. The workpiece supply stand and the workpiece recovering stand are disposed in forward and rearward positions with respect to a Y-direction that is perpendicular to an X-direction. Sewing heads are arranged in a row in the X-direction. Therefore, the workpiece is fed in the Y-direction that is perpendicular to the X direction, i.e., the direction of the row of the sewing heads. After the embroidering operation has been performed onto a part of the workpiece that is held by an embroidery frame, the embroidery frame is moved to a maximum forward stroke end in the Y-direction while the embroidered part is held by the embroidery frame. The embroidered part is then released from the embroidery frame, so that the workpiece returns to the original position in the Y-direction. Thereafter, the next part of the workpiece is held by the embroidery frame and the embroidering operation is again performed onto the next part.

As described above, in the known multi-head sewing machine, the workpiece is fed in the direction that is perpendicular to the direction of the row of the sewing heads. In addition, embroidery frames of multi-head sewing machines generally have widths that are greater enough than widths of workpieces to be embroidered. Therefore, two or more long workpieces are set onto an embroidery frame such that they are arranged in an X-direction with respect to the embroidery frame. With this arrangement, a maximum number of the sewing heads can be operated in order to perform the embroidering operation. Therefore, this arrangement is particularly effective for the purpose of mass production. However, in recent years, large item small scale production has become a mainstream of production of embroidery products. The known technique as described above is inefficient for this mainstream production in some cases.

SUMMARY OF THE INVENTION

It is accordingly an object of the present invention to teach improved multi-head sewing machines that is suitable to large item small scale production of sewn products According to one aspect of the present teachings, multi-head sewing machines are taught that may include a feeding mechanism for feeding a long workpiece, e.g. a long fabric or cloth. The feeding mechanism may feed the workpiece relative to a workpiece setting frame in a direction substantially parallel to a direction of a row of sewing heads.

Therefore, a single long workpiece can be sewn by using all the sewing heads that are arranged in the feeding direction of the workpiece. In addition, a setup operation or a setup changing operation of such a single workpiece can be quickly performed. As a result, the sewing machines can be advantageously used for large item small scale production of sewn products, in particular embroidery products.

According to another aspect of the present teachings, the sewing machines may further include a direction changing device disposed at least one of a forward position and a rearward position in the first direction with respect to the workpiece setting frame.

Therefore, the workpiece may be fed in the first direction along the workpiece setting frame without being interfered by any structural members of the sewing machine. For example, such structural members may be support members that support a support frame, on which the sewing heads are mounted.

Preferably, the direction changing device may be disposed on each of a front position and a rear position with respect to the workpiece setting frame, so that the feeding direction can be changed at both of the front and rear positions. For example, the direction changing device disposed at the front position may serve to change the feeding direction from a second direction to the first position. On the other hand the direction changing device disposed at the rear position may serve to change the feeding direction from the first direction to a third direction. The second direction may be directed toward a workpiece supply device, e.g., an unwinding device, and the third direction may be directed toward a workpiece recovering device, e.g., a winding device.

According to another aspect of the present teachings, methods of feeding long workpieces in multi-head sewing machines are taught. The methods may include feeding the workpiece from an unwinding device to a winding device via a workpiece setting frame. The workpiece may be fed in a first direction along the workpiece setting frame. The first direction may be substantially parallel to a direction of a row of sewing heads. The workpiece may be fed in a second direction from a workpiece supply device, e.g., an unwinding device, to the workpiece setting frame and may be fed in a third direction from the workpiece setting frame to a workpiece recovering device, e.g., a winding device.

Therefore, the workpiece may be fed in the same direction of the row of the sewing head, while the feeding direction is changed when the workpiece is supplied to the workpiece setting frame and is discharged from the workpiece setting frame in order to avoid interference of the workpiece with other parts of the sewing machine.

DETAILED DESCRIPTION OF THE INVENTION

Figure 1:
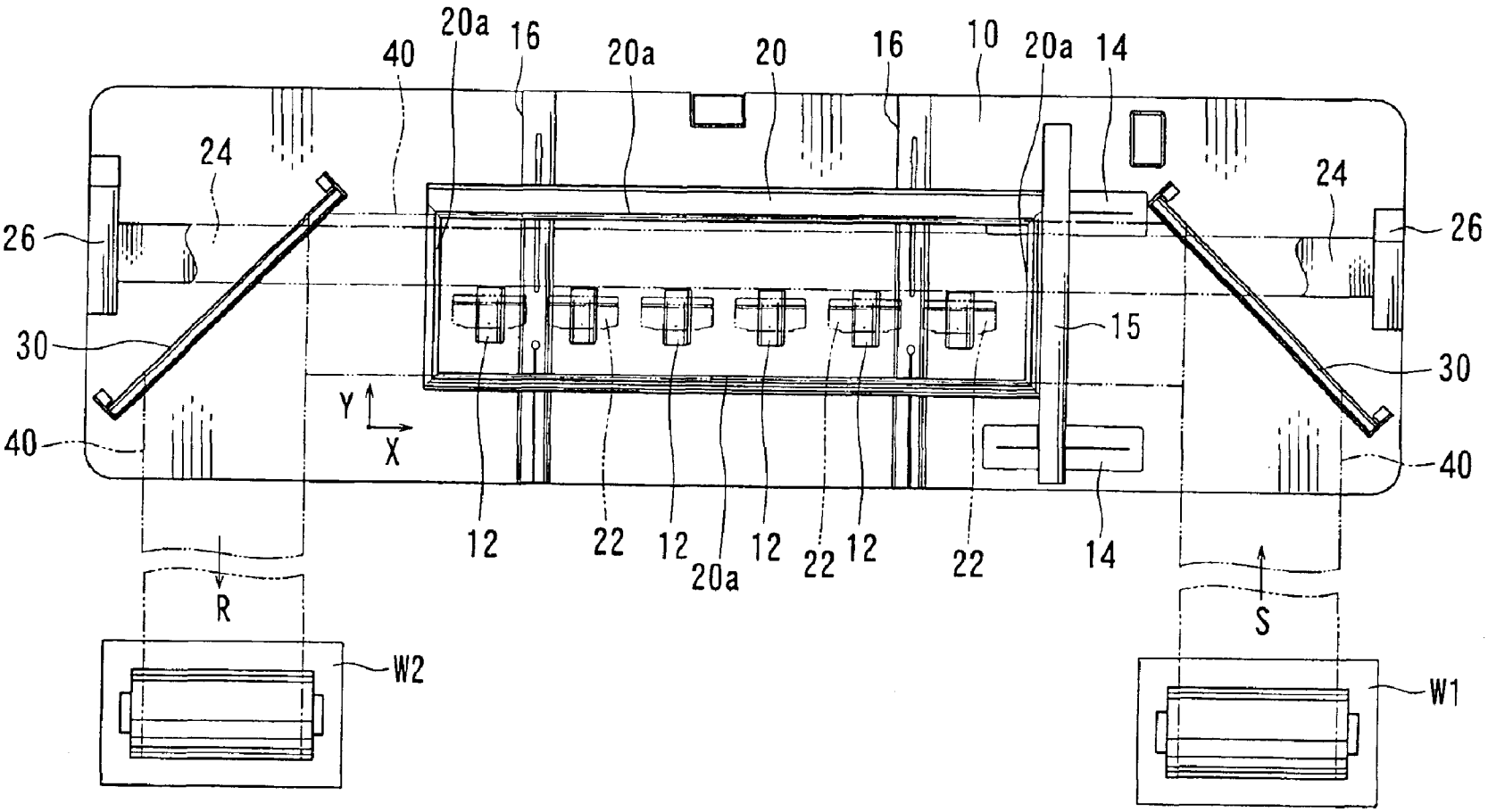
FIG. 1 is a plan view of a first representative multi-head sewing machine.

In one embodiment of the present teachings, multi-head sewing machines are taught that may include a machine table and a plurality of sewing heads. The sewing heads may be disposed to oppose to the machine table and may be arranged in a row in a first direction that is substantially parallel to a surface of the machine table. A workpiece setting frame may releasably hold a long workpiece having a predetermined width and a longitudinal direction. The workpiece setting frame may be movable within a plane that is substantially parallel to the surface of the machine table. A feeding mechanism may serve to feed the workpiece relative to the workpiece setting frame in a direction that is substantially parallel to the first direction.

Therefore, all the sewing heads can be used for sewing or embroidering a single long workpiece. First, a part of the workpiece may be sewn. Then, the workpiece may be fed in the first direction by a predetermined distance, e.g., a distance corresponding to the length of the sewn part. Therefore, another part of the workpiece next to the sewn part may be held by the workpiece setting frame and may be sewn by the sewing heads. These operations may be repeatedly performed, so that stitches or embroideries may be formed on the workpiece continuously or intermittently in the longitudinal direction.

Because the single long workpiece can be quickly set onto or removed from the feeding mechanism, a setup operation and a setup change operation can be quickly performed in comparison with the same operations that may be required in case that a plurality of long workpieces are fed by the feeding mechanism.

In another embodiment of the present teachings, the sewing heads may be mounted on a support frame that is supported by support members. The support members may be mounted on both ends of the table surface in the first direction.

In another embodiment of the present teachings, the feeding mechanisms may include a direction changing device that is disposed at least one of a forward position and a rearward position in the first direction with respect to the workpiece setting frame.

Because, the feeding direction of the workpiece may be changed at the forward position and/or the rearward position of the workpiece setting frame, the workpiece may be fed in the first direction along the workpiece setting frame without being interfered by other parts of the sewing head, e.g., support members mounted on the machine table for supporting sewing heads via a support frame.

The direction changing device may be disposed on the machine table or may be disposed on the workpiece setting frame.

In another embodiment of the present teachings, the direction changing device may include a bar, e.g., a roll bar, that engages the workpiece. Preferably, the bar may be disposed such that the longitudinal axis of the bar is inclined relative to the first direction by a predetermined angle, e.g., 45°, so that the feeding direction can be changed in response to the inclination angle of the bar. Preferably, the direction changing device may permit adjustment of an angle of inclination of the longitudinal axis of the bar relative to the first direction.

In another embodiment of the present teachings, a direction control device may be associated with the direction changing device, so that the feeding direction can be gradually changed toward the desired direction. Preferably, the direction control device may include a control bar that is fixed in position and extends in a direction substantially perpendicular to the first direction.

In another embodiment of the present teachings, the feeding mechanism may further include a workpiece supply device and a workpiece recovering device. In addition, the direction changing device may be disposed on each of the front position and the rear position with respect to the workpiece setting frame. Preferably, the workpiece supply device may be an unwinding device for storing the workpiece in a rolled configuration. The workpiece recovering device may be a winding device for winding the workpiece on which stitches or embroideries have been formed. The workpiece may be fed in a second direction from the unwinding device to the direction changing device disposed on the front position. On the other hand, the workpiece may be fed in a third direction from the direction changing device disposed on the rear position to the winding device. The first, second and third directions may be set substantially within the same plane that is parallel to the machine table. The second and third directions may be perpendicular to each other.

In another embodiment of the present teachings, methods of feeding long workpieces in multi-head sewing machines are taught. The sewing machines may include a plurality of sewing heads that are arranged in a row in a first direction. The methods may include the steps of:

feeding the workpiece in a second direction from a workpiece supply device to a first position that may be a front position of a workpiece setting frame;

changing the feeding direction of the workpiece from the second direction to the first direction at the first position;

feeding the workpiece from the first position to the second position along the workpiece setting frame, changing the feeding direction of the workpiece from the first direction to a third direction at a second position that may be a rear position of the workpiece setting frame, and feeding the workpiece toward a workpiece recovery device in the third direction.

Therefore, the workpiece may be fed in the same direction of the row of the sewing head, and the feeding direction is changed at forward and rearward positions of the workpiece setting frame in order to avoid interference of the workpiece with other parts of the sewing machine.

Each of the additional features and teachings disclosed above and below may be utilized separately or in conjunction with other features and teachings to provide improved multi-head sewing machines and improved methods of feeding long workpieces in multi-head sewing machines. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

A first representative embodiment will now be described with reference to FIGS. 1 to 4 and 5(A) to 5(C).

Figure 2:
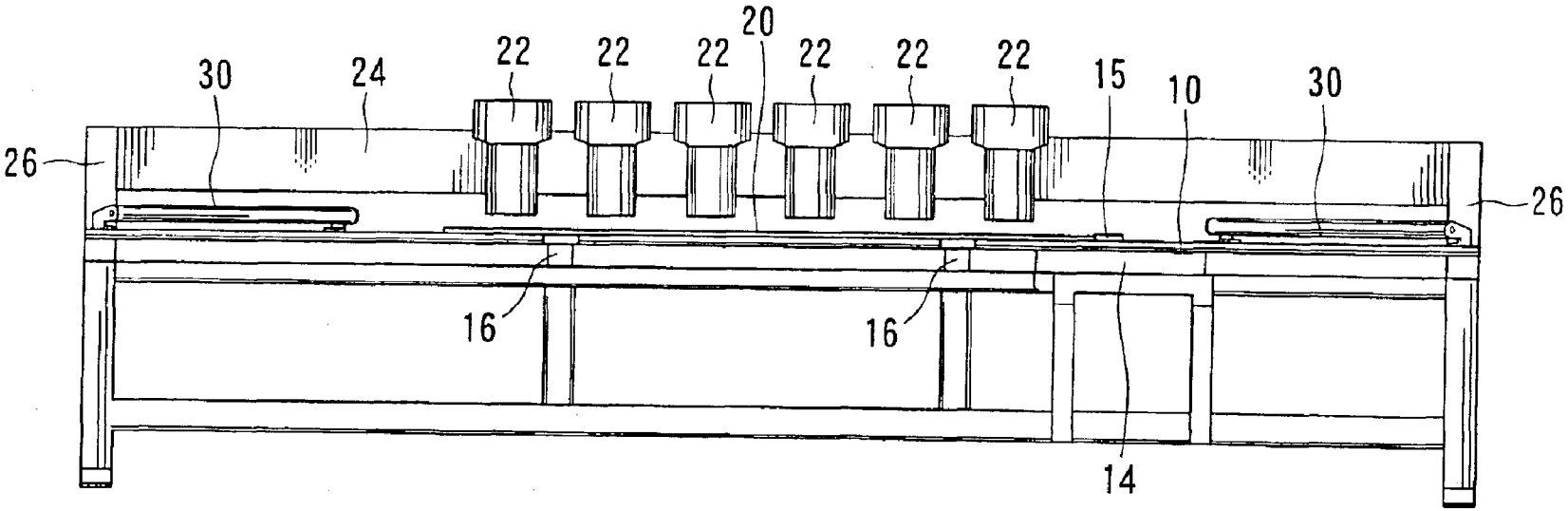
FIG. 2 is a front view of the first representative multi-head sewing machine.

Referring to FIGS. 1 and 2, a first representative multi-head sewing machine is shown in a plan view and a front view, respectively. As shown in FIGS. 1 and 2, a plurality of sewing heads 22 (six sewing heads 22 are shown in the drawings) may be arranged in a row in an X-direction (right and left directions as viewed in FIG. 1). The sewing heads 22 may be spaced equally from each other by a predetermined distance. Each of the sewing heads 22 may have a plurality of sewing needles (not shown) that are supported on a needle case (not shown). In order to perform the sewing operation, one of the needle bars may be selected by slidably shifting the needle case relative to the sewing head 22, so that the selected needle bar can be driven by a needle drive device (not shown). Threads (not shown) having different colors or properties may extend through the respective sewing needles.

The sewing heads 22 may be mounted on the front side of a support frame 24 that extends in the X-direction over the machine table 10. Both ends of the support frame 24 may be supported by support members 26 that are fixed to the upper surface of the machine table 10 at both ends of the machine table 10 in the X-direction. As shown in FIG. 1, a plurality of throat plates 12 may be disposed on the machine table 10 in positions opposing to the respective sewing heads 22.

As shown in FIGS. 1 and 2, an X-axis drive device 14 and a pair of Y-axis drive devices 16 may be disposed below the machine table 10. An X-axis drive member 15 may be disposed on the machine table 10 and may be coupled to the X-axis drive device 14, so that the X-axis drive member 15 may move in the X-direction as the X-axis drive device 14 is driven. A workpiece setting frame 20 may be disposed on the machine table 10 and may have a rectangular configuration elongated in the X-direction. The right shorter side of the workpiece setting frame 20 may be coupled to the X-axis drive member 15 such that the workpiece setting frame 20 can move together with the X-axis drive member 15 but is permitted to move in the Y-direction relative to the X-axis drive member 15. The longer sides of the workpiece setting frame 20 may be coupled to the Y-axis drive devices 16 such that the workpiece setting frame 20 can move together with the Y-axis drive devices 16 but is permitted to move in the X-direction relative to the Y-axis drive devices 16. As a result, the workpiece setting frame 16 can be moved in the X-direction and the Y-direction relative to the machine table 10 in response to the driving operations of the X-axis drive device 14 and the Y-axis drive devices 16.

Preferably, a projection 20*a* may be formed on an inner circumferential edge of the workpiece setting frame 20 for engagement by clips (not shown). In order to set a long workpiece 40 onto the workpiece setting frame 20, a part of the workpiece 40 to be sewn may be placed on the workpiece setting frame 20 and then may be clamped against the projection 20*a* of the workpiece setting frame 20 by means of the clips. In this way, the workpiece 40 can be held by the workpiece setting frame 20 for a sewing operation, i.e., an embroidering operation. After the sewing operation has been completed, the clips may be removed, so that the workpiece 40 can be released from the workpiece setting frame 20.

Although the operations for setting the workpiece 40 onto the embroidery frame 20 and for releasing the workpiece 40 from the embroidery frame 20 are manually made in this representative embodiment, such operations can be automatically performed by incorporating a workpiece pressing frame and an actuator (not shown) that serves to actuate the workpiece pressing frame in order to clamp the workpiece 40 against the workpiece setting frame 20.

The workpiece 40 may be a long fabric having a predetermined width and may be stored at an unwinding device W1. The unwinding device W1 may be disposed on the front side in the Y-direction of the sewing machine and may store the workpiece 40 in a rolled configuration. In this representative embodiment, the workpiece 40 may be fed leftward in the X-direction relative to and along the workpiece setting frame 20. Because the support members 26 for the support frame 24 of the sewing heads 22 are disposed on both sides of the machine table 10 and oppose to the workpiece setting frame 24 in the X-direction, the representative embodiment is configured to change the feeding direction of the workpiece 40 in order to avoid interference with the support members 26. To this end, direction changing devices 30 may be disposed on the machine table 10 in positions adjacent both ends of the workpiece setting frame 20 in the X-direction and may serve to change the feeding direction of the workpiece 40.

Figure 3:
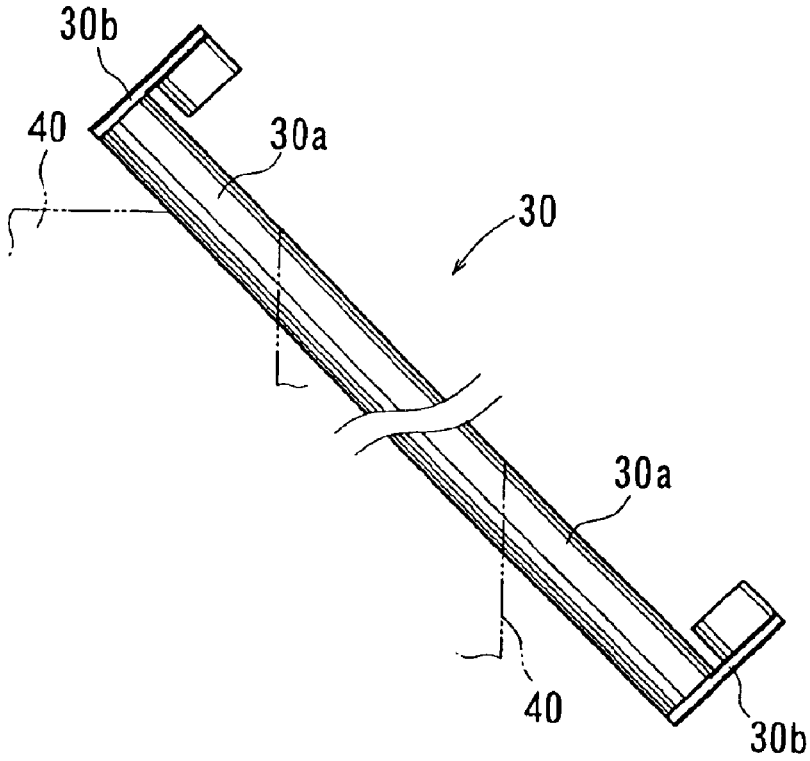
FIG. 3 is an enlarged plan view of a direction changing device disposed on the right side as viewed in FIG. 1.
Figure 4:
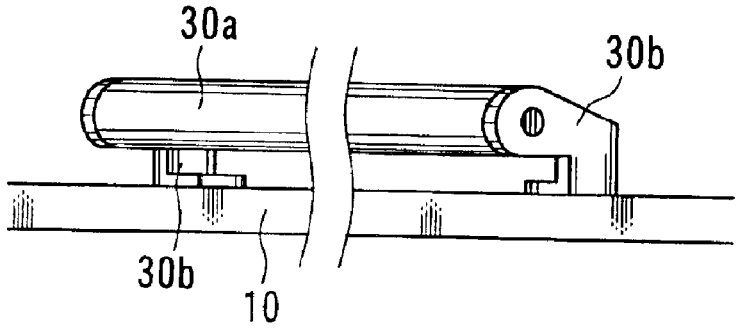
FIG. 4 is a front view of the direction changing device shown in FIG. 3.

Referring to FIG. 3, the direction changing device 30 disposed on the right side as viewed in FIG. 1 is shown in a plan view. This direction changing device 30 is shown in an enlarged front view in FIG. 4. As will be seen from FIGS. 3 and 4, the changing device 30 may include a roll bar 30*a* and a pair of support brackets 30*b*. The support brackets 30*b* may serve to support both ends of the roll bar 30*a* and may be fixed to the upper surface of the machine table 10. Another direction changing device 30 disposed on the left side as viewed in FIG. 1 may have the same construction as the direction changing device 30 disposed on the right side.

As shown in FIG. 1, the roll bar 30*a* of each of the changing devices 30 may be positioned such that the longitudinal axis of the roll bar 30*a* is inclined relative to the X-direction by an angle of about 45°. The workpiece 40 may be engaged by the roll bars 30*a* of the direction changing device 30, so that the feeding direction of the workpiece 40 may be changed by an angle of about 90° at positions adjacent to both ends of the workpiece setting frame 20 in the X-direction. Referring to again FIG. 1, the workpiece 40 may be fed or unwound from the unwinding device W1 in a direction as indicated by an arrow S that is parallel to the Y-direction. In addition, the workpiece 40 may be recovered or wound by a winding device W2, to which the workpiece 40 is fed in a direction as indicated by an arrow R that is also parallel to the Y-direction.

The angle of inclination of the roll bars 30*a* may not be necessary to be an angle of 45°. In other words, the turning angle of the workpiece 40 may not be necessary to be an angle of 90°. Thus, it is only essential that the direction changing devices 30 serve to change the feeding direction of the workpiece 40 such that the workpiece 40 is not interfered by the support members 26. Preferably, the roll bar 30*a* of each of the direction changing devices 30 may be rotatably supported by the support brackets 30*b*. Alternatively, the roll bar 30*a* may be fixedly supported by the support brackets 30*b*.

Figure 5:
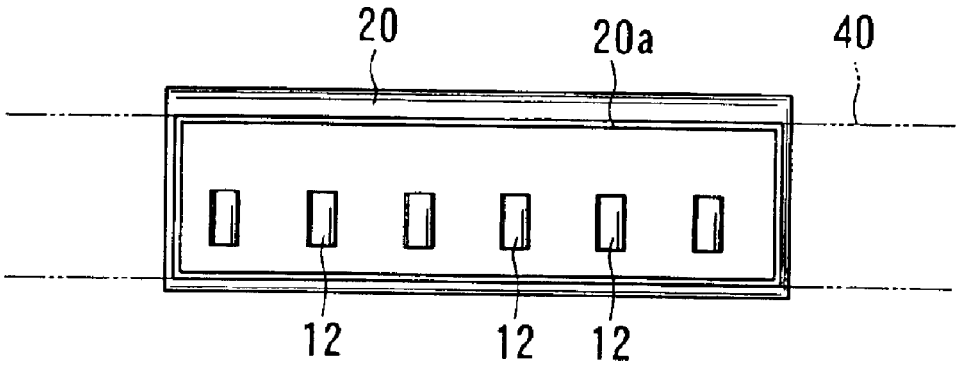
FIGS. 5(A) to 5(C) are schematic plan views showing the changes of positional relationship between throat plates of a machine table and a workpiece setting frame during an embroidering operation of the first representative multi-head sewing machine.
Figure 5:
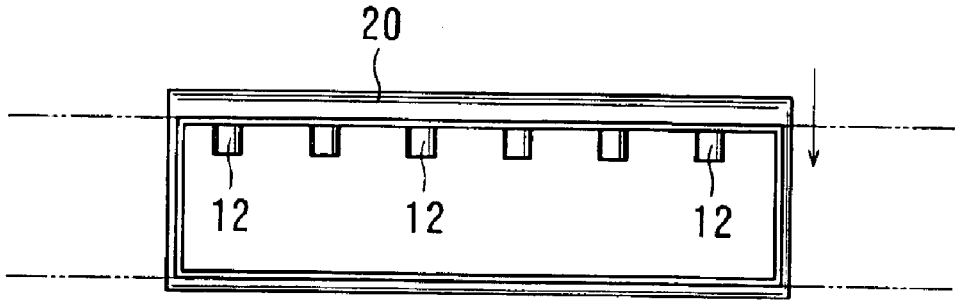
Figure 5:
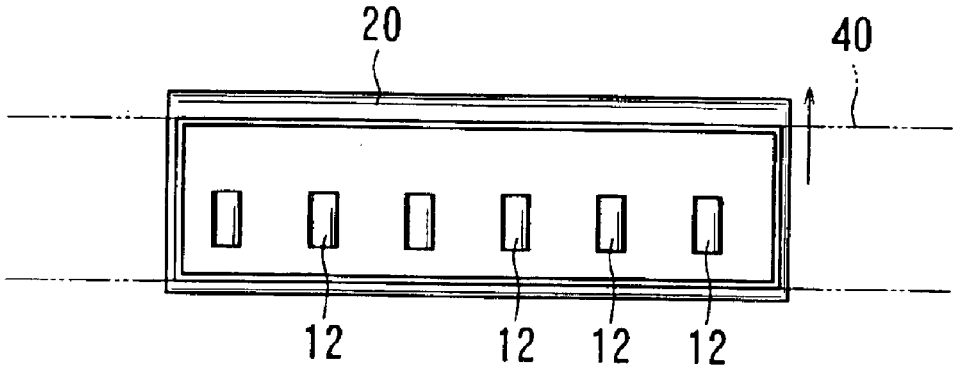

Referring to FIGS. 5(A), 5(B) and 5(C), various relative positions between the throat plates 12 of the machine table 10 and the workpiece setting frame 20 are schematically shown in plan views. The operation of the above representative embodiment will now be described mainly with reference to FIGS. 5(A) to 5(C) in connection with the operation for forming stitches (embroideries) on the workpiece 40.

First, the workpiece 40 may be set to extend from the unwinding device W1 to the winding device W2 via the right side direction changing device 30, the workpiece setting frame 20 and the left side direction changing device 30. Then, a part of the workpiece 40 may be set onto the workpiece setting frame 20 in a manner as described previously. Thereafter, the workpiece setting frame 20 may be moved in the X-direction and the Y-direction by the X-axis drive device 14 and the Y-axis drive devices 16, respectively, according to embroidery data that may be inputted to a CPU of a control device (not shown), which control device may output control signals to the X-axis drive device 14 and the Y-axis drive devices 16. At the same time, the sewing heads 22 may be driven to reciprocally move the respective needle bars (i.e., the respective sewing needles), so that an embroidery pattern may be formed on the part of the workpiece 40 that is held by the workpiece setting frame 20. FIG. 5(A) shows the state after completion of the embroidering operation.

Then, the workpiece setting frame 20 may be moved to a maximum forward stroke end in the Y direction (downward direction as viewed in FIG. 5(A)), so that the workpiece setting frame 20 may be moved from the position below the sewing heads 20 to a position on the side of an operator, who is positioned on the front side of the sewing machine, as shown in FIG. 5(B). Thereafter, the clips (not shown) may be removed to release the workpiece 40 from the workpiece setting frame 20. After that, the workpiece 40 may be fed in the X-direction along the workpiece setting frame 20 toward the winding device W2 by a predetermined distance, so that the workpiece setting frame 20 may oppose to a second part of the workpiece 40 next to the part that has been embroidered. Then, the clips may be fitted to the workpiece setting frame 20 in order to hold the second part of the workpiece 40. Subsequently, the workpiece setting frame 20 may be moved to return to the original position as shown in FIG. 5(C) and the second part may be embroidered in the same manner as described above. These steps may be repeatedly performed, so that embroidery patterns may be continuously or intermittently formed along the length of the workpiece 40.

The operation for unwinding the rolled workpiece 20 from the unwinding device W1 or the operation for winding the workpiece 20 by the winding device W2 may be manually performed or may be automatically performed by using an appropriate rotary drive device, e.g., an electric motor.

As described above, according to the first representative embodiment, the workpiece 40 may be fed in the same direction as the direction of the row of the sewing heads 22 relative to and along the workpiece setting frame 20. Therefore, all the sewing heads 22 can be used to embroider a single workpiece. In addition, because it is only necessary to set a single workpiece onto the sewing machine, a setup operation and a setup change operation can be quickly performed. Further, because the feeding direction of the workpiece 40 can be changed by the direction changing devices 30, the feeding operation of the workpiece 40 may not be interfered by the support members 26 that are disposed on both sides of the machine table 10. Therefor, the feeding operation of the workpiece 40 in the direction of the row of the sewing heads 22 can be performed without any problem.

Figure 6:
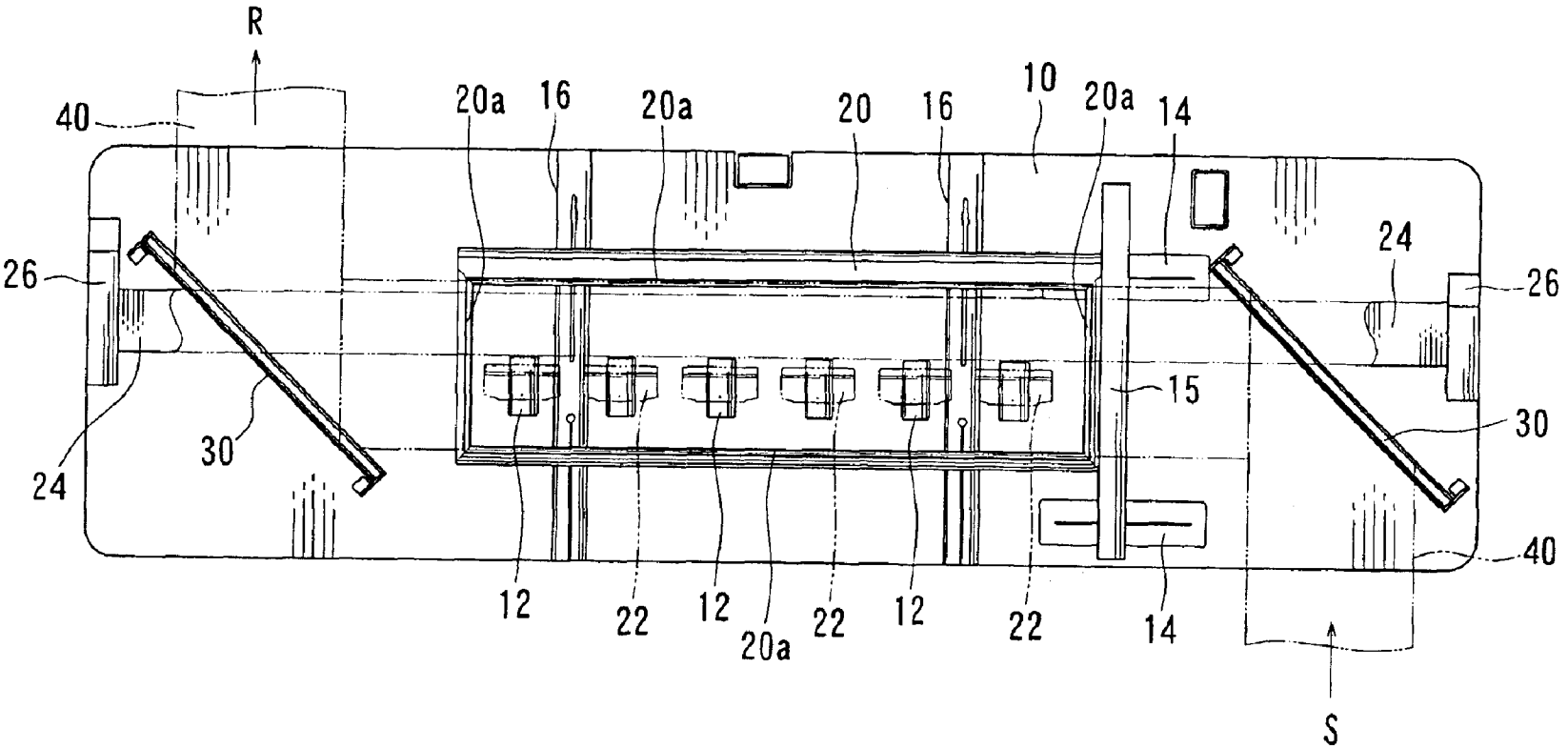
FIG. 6 is a plan view of a multi-head sewing machine according to a modification of the first representative multi-head sewing machine.

Referring to FIG. 6, there is shown a modification of the first representative embodiment, in which the direction of inclination relative to the X-direction of the direction changing device 30 disposed on the left side is opposite to the inclination direction of the corresponding direction changing device 30 of the first representative embodiment. With this arrangement, the winding device W2 may be disposed on the side opposite to the unwinding device S with respect to the machine table 10. The modification shown in FIG. 6 is only one example of various possible modifications of the first representative embodiment. For example, the first representative embodiment also may be modified such that the direction of inclination relative to the X-direction of the changing device 30 disposed on the right side is opposite to the direction shown in FIG. 1. Alternatively, the first representative embodiment may be modified such that the directions of inclinations relative to the X-direction of both the right and left side changing devices 30 are opposite to the directions shown in FIG. 1.

Figure 7:
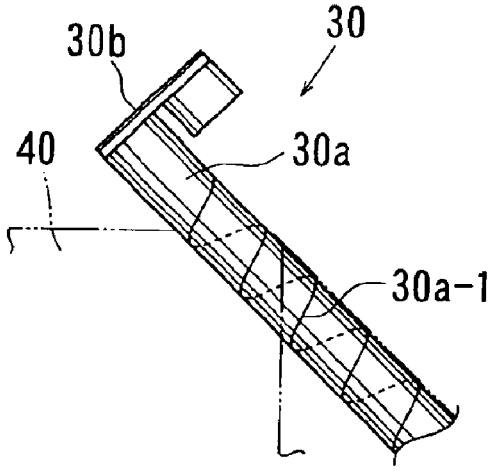
FIG. 7 is an enlarged plan view of a part of a direction changing device according to another modification of the first representative multi-head sewing machine.

Referring to FIG. 7, there is shown another modification of the first representative embodiment, in which a spiral projection 30*a*-1 is formed on an outer circumferential surface of the roll bar 30*a* of each direction changing device 30. The spiral projection 30*a*-1 may serve to minimize slippage of the workpiece 40 on the roll bar 30*a*.

A second representative embodiment will now be described with reference to FIGS. 8 to 10. The second representative embodiment is a further modification of the first representative embodiment. Therefore, in FIGS. 8 to 10, like members are given the same reference numerals as the first representative embodiment, and the description of these members will not be necessary.

Figure 8:
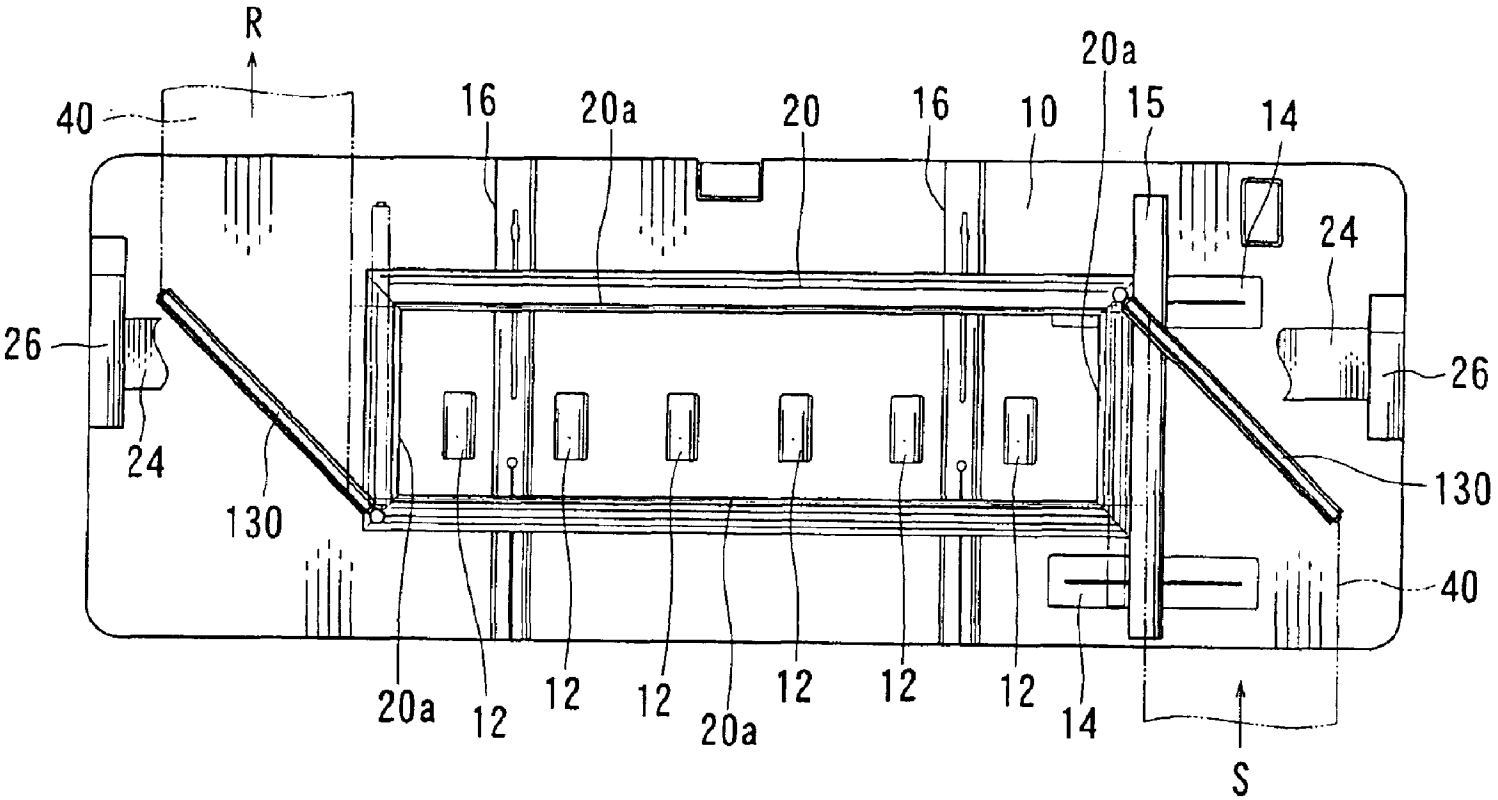
FIG. 8 is a plan view of a second representative multi-head sewing machine.
Figure 9:
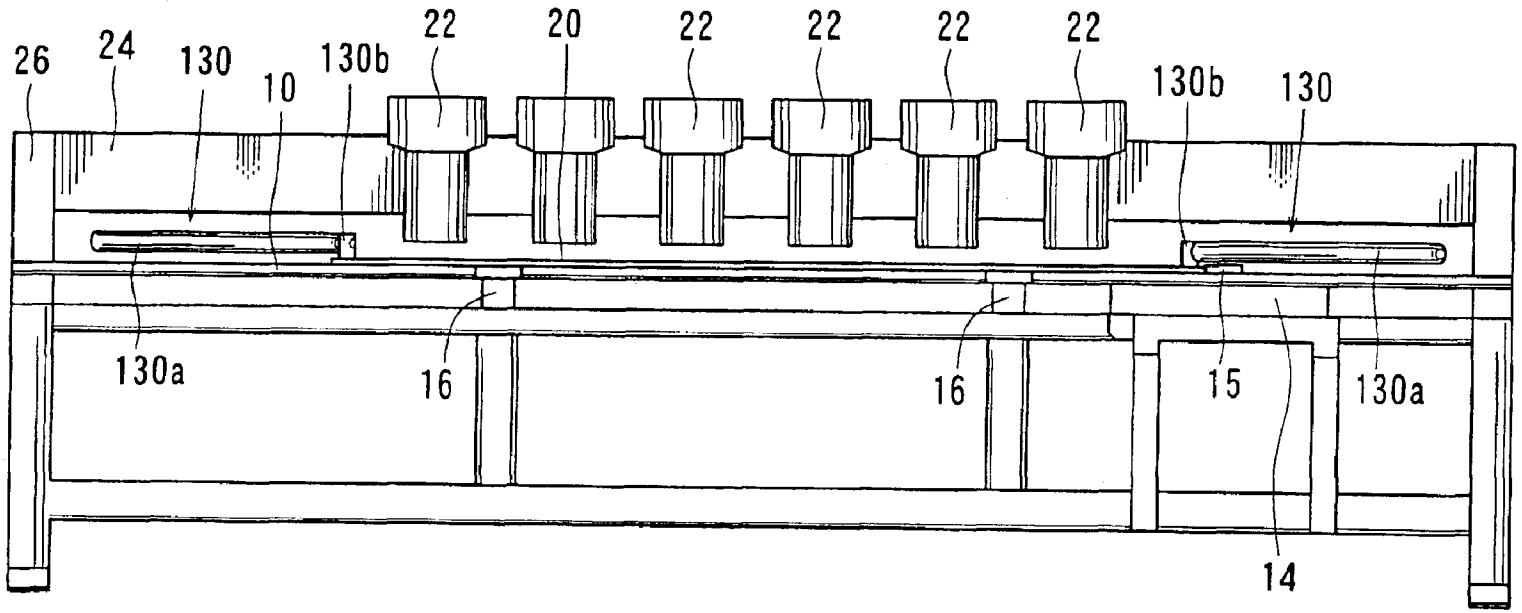
FIG. 9 is a front view of the second representative multi-head sewing machine.
Figure 10:
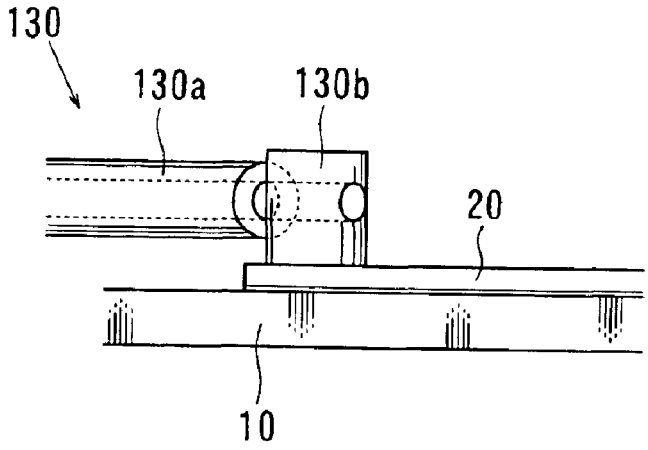
FIG. 10 is an enlarged view of a part of the second representative multi-head sewing machine.

Referring to FIGS. 8 and 9, there is shown a second representative multi-head sewing machine in a plan view and a front view, respectively. FIG. 10 shows an enlarged view of a part of FIG. 9. As will bee seen from these figures, the second representative sewing machine may include direction changing devices 130 that are adapted to change the feeding direction of the workpiece 40 and are disposed on both ends in the X-direction of the workpiece setting frame 20. As shown in FIG. 10, each of the direction changing devices 130 may include a roll bar 130*a* and a support post 130*b* that supports one end of the roll bar 130*a*. The support post 130*b* may extend upward from the workpiece setting frame 20 and may be rotatable relative to the workpiece setting frame 20 about the longitudinal axis of the support post 130*b*, so that the roll bar 130*a* can pivot together with the support post 130*b* relative to the workpiece setting frame 20. Thus, the roll bar 130*a* can pivot between an operative position and a storage position indicated by solid lines and virtual lines, respectively, in FIG. 8. In addition, the roll bar 130*a* may be locked at each of the operative position and the storage position by appropriate lock devices (not shown).

When the roll bar 130*a* is in the operative position, the roll bar 130*a* is inclined by an angle of about 45° relative to the X-direction. Therefore, by positioning the roll bar 130*a* of each direction changing device 130 at the operative position, the feeding direction of the workpiece 20 may be changed by an angle of about 90° at each end of the workpiece setting frame 20 in the X-direction. In the second representative embodiment, the unwinding device W1 and the winding device W2 (not shown in FIGS. 8 to 10) may be disposed on the same side as the modification of the first representative embodiment shown in FIG. 6. Because the direction changing devices 130 are disposed directly on the workpiece setting frame 20, direction changing points of the workpiece 40 may be moved in response to the movement of the workpiece setting frame 20 during the embroidering operation. As a result, no excessive force may be applied to the workpiece 40. The roll bar 130*a* of each direction changing device 130 may be locked at the storing position when the sewing machine is not used or when the sewing machine is used for embroidering a workpiece other than the long workpiece 40.

A third representative embodiment will now be described with reference to FIGS. 11 to 13. Also, the third representative embodiment is a modification of the first representative embodiment. Therefore, in FIGS. 11 to 13, like members are given the same reference numerals as the first representative embodiment, and the description of these members will not be necessary.

Figure 11:
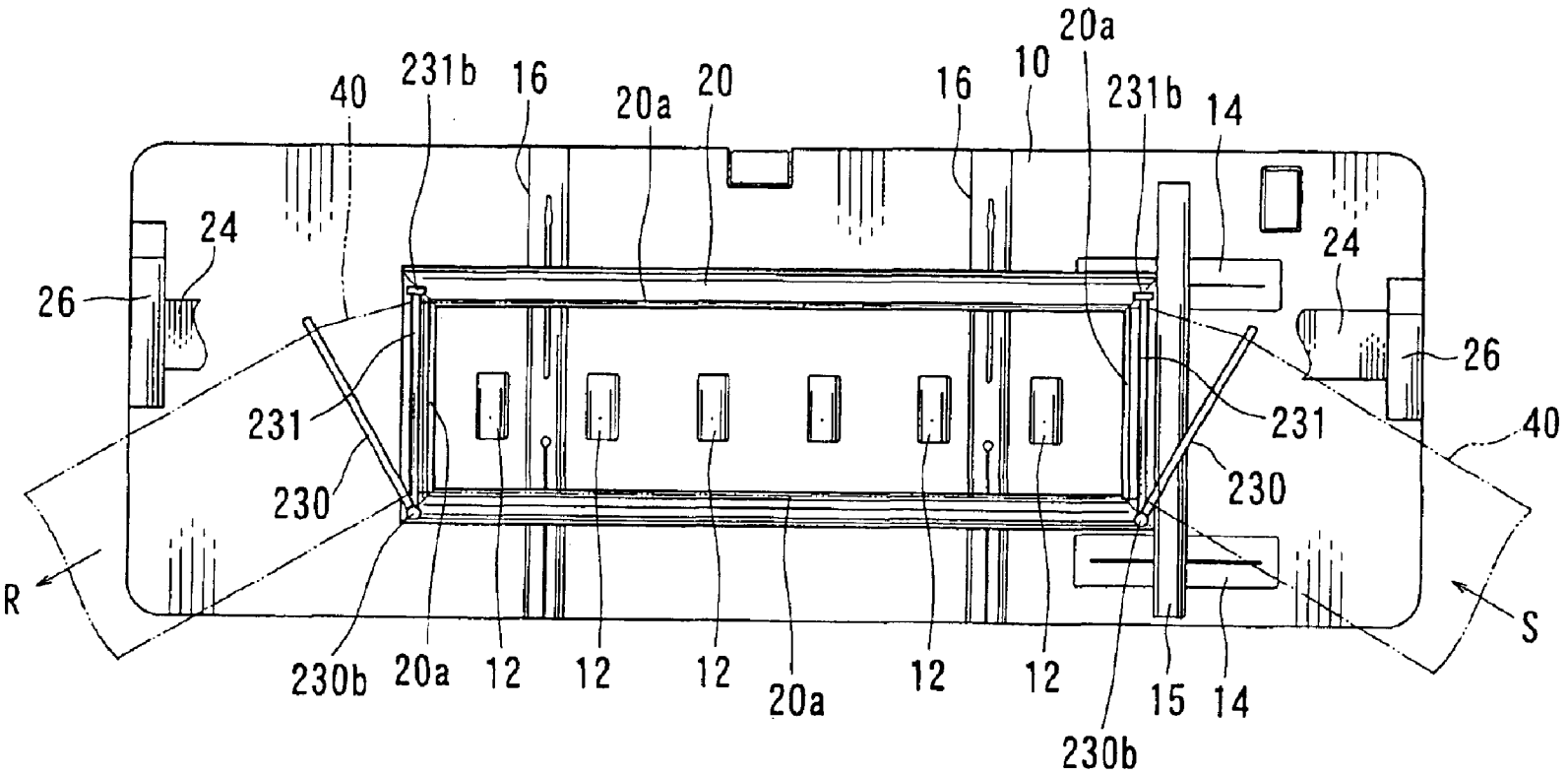
FIG. 11 is a plan view of a third representative multi-head sewing machine.
Figure 12:
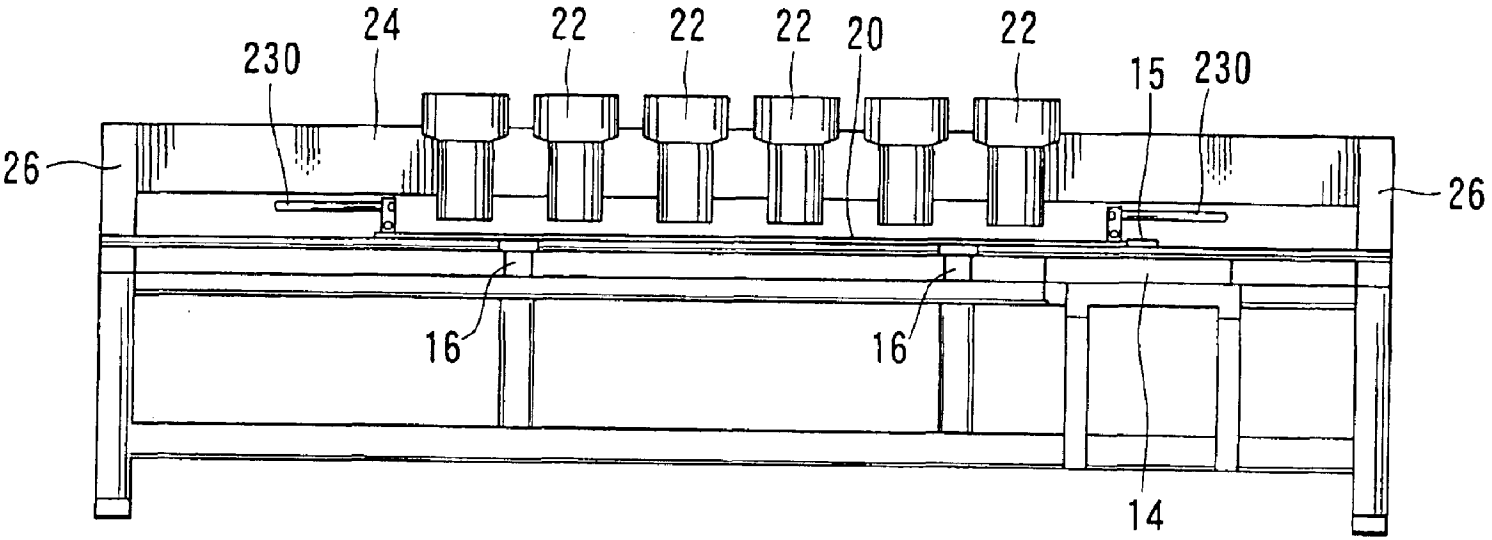
FIG. 12 is a front view of the third representative multi-head sewing machine.
Figure 13:
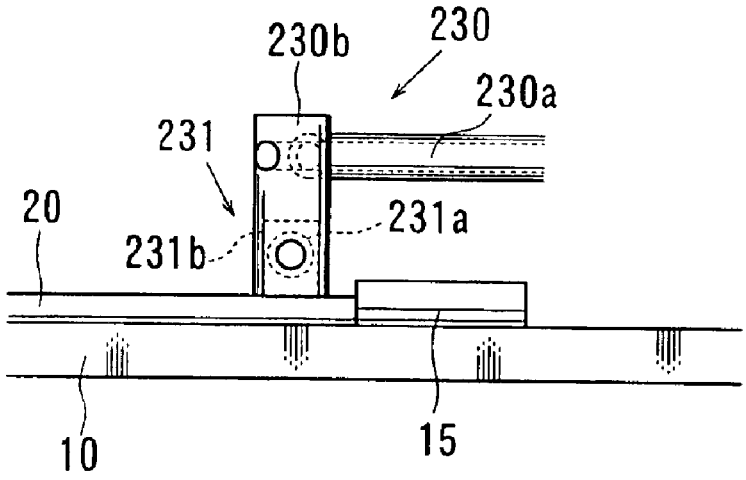
FIG. 13 is an enlarged view of a part of the third representative multi-head sewing machine.

Referring to FIGS. 11 and 12, a third representative multi-head sewing machine is shown in a plan view and a front view, respectively. FIG. 13 is an enlarged view of a part of FIG. 12. The third representative multi-head sewing machine may include a first direction changing device 230 and a second direction changing device 231 that are disposed on each of opposite ends in the X-direction of the workpiece setting frame 20. The second direction changing device 231 may be positioned below the first direction changing device 230.

The first direction changing device 230 may include a roll bar 230*a*. One end of the roll bar 230*a* may be supported by a support post 230*b* that is fixed to the workpiece setting frame 20. The roll bar 230*a* may be inclined relative to the X-direction (by a small angle relative to the Y-direction). The second direction changing device 231 may include a roll bar 231*a*. Both ends of the roll bar 231*a* may be supported by the support post 230*b* and a support post 231*b*, respectively. The support post 231*b* may be fixed to the workpiece setting frame 20 in a position opposite to the support post 230*b* in the Y-direction. Therefore, the roll bar 231*a* may extend in parallel to the short sides of the workpiece setting frame 20. In other words, the roll bar 231*a* may extend substantially perpendicular to the X-direction.

The workpiece 40 may be engaged by the roll bar 230*a* and the roll bar 231*a* on each side of the workpiece setting frame 20. Therefore, the workpiece 40 may be fed in the direction of the arrow S from the unwinding device W1 to the workpiece setting frame 20 via the roll bar 230*a* and the roll bar 231*a* that are disposed on the right side as viewed in FIG. 11. The workpiece 40 may be further fed in the direction indicated by the arrow R to the winding device W2 via the roll bar 231*a* and the roll bar 230*a* that are disposed on the left side as viewed in FIG. 11. With this arrangement, the feeding direction of the workpiece 40 may be gradually changed as it passes through the roll bar 230*a* and the roll bar 231*a* on each side of the workpiece setting frame 20. Therefore, change of direction from the direction indicated by the arrow S to the X-direction and change of the direction from the X-direction to the direction indicated by the arrow R can be smoothly performed without applying excessive forces to the workpiece 40. Preferably, the roll bar 230*a* of the first direction changing device 230 may be supported by the support post 230*b* such that the roll bar 230*a* can pivot about the axis of the support post 230*b*. Therefore, it is possible to position the roll bar 230*a* in a storage position, where the roll bar 230*a* extends in parallel to the corresponding short side of the embroidery frame 20. In addition, this arrangement may enable to adjust the inclination angle of the roll bar 230*a* relative to the X-direction or the Y-direction in an operative position of the roll bar 230*a*.

The first to third representative embodiments and their modifications have been described in connection with multi-head sewing machines that have support members 26 disposed on both sides in the X-direction of the machine table 10. Therefore, in these representative embodiments, the feeding direction of the workpiece 40 is changed by the direction changing devices in order to avoid interference of the support members 26 with the workpiece 40. However, if the support frame 24 for supporting the sewing heads 22 is supported by support members that are arranged in a different manner from the support members 26 of the representative embodiments, it will not be necessary to consider the interference with the support members. For example, each of the support members may be mounted on the front portion and/or rear portion of the machine table 10 and may have an extension that extends over the machine table 10, so that a space is provided between the extension and the machine table 10. With this arrangement, the support members may not interfere with the workpiece 40 even if the workpiece 40 is fed in the X-direction. Therefore, it is not necessary to provide direction changing devices for changing the feeding direction of the workpiece 40.

What is claimed is:

1. A multi-head sewing machine comprising:

a machine table;

a plurality of sewing heads disposed to oppose to the machine table and arranged in a row in a first direction, the first direction being substantially parallel to a surface of the machine table;

a workpiece setting frame arranged and constructed to releasably hold a long workpiece having a predetermined width and a longitudinal direction, the workpiece setting frame being movable within a plane that is substantially parallel to the surface of the machine table; and a feeding mechanism for feeding the workpiece relative to the workpiece setting frame in a direction substantially parallel to the first direction.

2. A multi-head sewing machine as in claim 1, wherein the feeding mechanism comprises a direction changing device disposed at least one of a forward position and a rearward position in the first direction with respect to the workpiece setting frame.

3. A multi-head sewing machine as in claim 2, wherein the direction changing device is disposed on each of the forward an rearward positions with respect to the workpiece setting frame.

4. A multi-head sewing machine as in claim 2, wherein the direction changing device is arranged and constructed to change the feeding direction of the workpiece between the first direction and a second direction that is substantially perpendicular to the first direction.

5. A multi-head sewing machine as in claim 2 further including structural members, the structural members constituting parts of the sewing machine and disposed on both ends of the machine table in the first direction, wherein the direction changing device is arranged and constructed to change the direction of the workpiece such that the corresponding structural member disposed on the same side as the direction changing device does not interfere with the workpiece.

6. A multi-head sewing machine as in claim 5, wherein the direction changing device is disposed on the machine table in a position between the workpiece setting frame and each of the structural members.

7. A multi-head sewing machine as in claim 6, wherein the direction changing device is disposed adjacent to the workpiece setting frame.

8. A multi-head sewing machine as in claim 5, wherein the direction changing device is disposed on the workpiece setting frame.

9. A multi-head sewing machine as in claim 5 further including a support frame arranged and constructed to support the sewing heads and having a longitudinal direction in the first direction, wherein the structural members comprise support members disposed on both ends of the machine table for supporting the support frame.

10. A multi-head sewing machine as in claim 2, wherein the direction changing device comprises a bar for engaging the workpiece.

11. A multi-head sewing machine as in claim 10, wherein the bar is a roll bar.

12. A multi-head sewing machine as in claim 10, wherein the bar has a longitudinal axis that is inclined relative to the first direction by a predetermined angle.

13. A multi-head sewing machine as in claim 10, wherein the bar has a longitudinal axis and the direction changing device is arranged and constructed to permit adjustment of an angle of inclination of the longitudinal axis of the bar relative to the first direction.

14. A multi-head sewing machine as in claim 10 further including a direction control device associated with the direction changing device, wherein the direction control device comprises a control bar that is fixed in position and extends in a direction substantially perpendicular to the first direction.

15. A multi-head sewing machine comprising:

a machine table;

a plurality of sewing heads disposed above the machine table and arranged in a row in a first direction, the first direction being substantially parallel to a surface of the machine table;

a workpiece setting frame arranged and constructed to releasably hold a long workpiece having a predetermined width and a longitudinal direction, wherein the workpiece setting frame is disposed between the sewing heads and the machine table and is movable within a plane that is substantially parallel to the surface of the machine table; and a feeding mechanism for feeding the workpiece, the feeding mechanism comprising:

a workpiece supply device;

a workpiece recovery device; and a first direction changing device and a second direction changing device disposed on both sides of the workpiece setting frame in the first direction, wherein:

the first direction changing device comprises a first bar for engaging the workpiece that has been fed from the workpiece supply device in a second direction that is different from the first direction, so that the feeding direction of the workpiece is changed from the second direction to the first direction by the first bar, the second direction changing device comprises a second bar for engaging the workpiece that has been changed in the feeding direction to the first direction by the first direction changing device, so that the feeding direction of the workpiece is changed from the first direction to a third direction that is different from the first direction and is directed toward the workpiece recovery device, and the workpiece is fed in the first direction along the workpiece setting frame between the first bar and the second bar.

16. A multi-head sewing machine as in claim 15, wherein the first and second direction changing devices are mounted on the machine table.

17. A multi-head sewing machine as in claim 15, wherein the first and second direction changing devices are mounted on the workpiece setting frame.

18. A multi-head sewing machine as in claim 15 further including:

a support frame arranged and constructed to support the sewing heads and having a longitudinal direction in the first direction, and a first support member and a second support member disposed on both ends of the machine table for supporting the support frame, wherein, the first direction changing device is arranged and constructed such that the first support member does not interfere with the workpiece that extends from the workpiece supply device toward the first direction changing device, and the second direction changing device is arranged and constructed such that the second support member does not interfere with the workpiece that extends from the second direction changing device toward the workpiece recovery device.

19. A method of feeding a long workpiece having a predetermined width in a multi-head sewing machine, the sewing machine comprising:

a machine table;

a plurality of sewing heads disposed above the machine table and arranged in a row in a first direction that is substantially parallel to a surface of the machine table;

a workpiece setting frame arranged and constructed to releasably hold the workpiece, wherein the workpiece setting frame is disposed between the sewing heads and the machine table and is movable within a plane that is substantially parallel to the surface of the machine table;

a workpiece supply device; and a workpiece recovery device, the method comprising:

feeding the workpiece in a second direction from the workpiece supply device to a first position forwardly of the workpiece setting frame in the first direction, wherein the second direction is different from the first direction, changing the feeding direction of the workpiece from the second direction to the first direction at the first position;

feeding the workpiece from the first position to a second position in the first direction along the workpiece setting frame, wherein the second position is disposed rearwardly of the workpiece setting frame in the first direction, changing the feeding direction of the workpiece from the first direction to a third direction at the second position, wherein the third direction is different from the first direction, and feeding the workpiece toward the workpiece recovery device in the third direction.

20. A method as in claim 19, wherein the first, the second and the third directions are set within a plane that is substantially parallel to the machine table, and the second and third directions are substantially perpendicular to the first direction.

21. A method as in claim 19, wherein the first position and the second position are adjacent to the a front end and a rear end in the first direction of the workpiece setting frame, respectively.

22. A multi-head sewing machine comprising:

a machine table, a plurality of sewing heads disposed above the machine table and arranged in a row in a first direction substantially parallel to a surface of the machine table;

a workpiece setting frame arranged and constructed to releasably hold a long workpiece having a predetermined width, wherein the workpiece setting frame is disposed between the sewing heads and the machine table and is movable within a plane substantially parallel to the surface of the machine table;

means for supplying the workpiece;

means for recovering the workpiece;

means for feeding the workpiece in a second direction from the supplying means to a first position forwardly of the workpiece setting frame in the first direction, wherein the second direction is different from the first direction, means for changing the feeding direction of the workpiece from the second direction to the first direction at the first position;

means for feeding the workpiece from the first position to a second position in the first direction along the workpiece setting frame, wherein the second position is disposed rearwardly of the workpiece setting frame in the first direction, means for changing the feeding direction of the workpiece from the first direction to a third direction at the second position, wherein the third direction is different from the first direction, and means for feeding the workpiece toward the recovering means in the third direction.

* * * * *